US006209612B1

(12) United States Patent
Schack et al.

(10) Patent No.: US 6,209,612 B1
(45) Date of Patent: Apr. 3, 2001

(54) LOCKING DEVICE FOR A DOOR SYSTEM

(75) Inventors: Arnold Schack, Ennepetal; Heinz Kleyer, Herne; Torsten Niederste-Ostholt, Wetter, all of (DE)

(73) Assignee: DORMA GmbH + Co. KG, Ennepetal (DE)

( * ) Notice: Subject to any disclaimer, the term of this patent is extended or adjusted under 35 U.S.C. 154(b) by 0 days.

(21) Appl. No.: 09/482,144

(22) Filed: Jan. 12, 2000

(30) Foreign Application Priority Data

Jan. 13, 1999 (DE) ..... 199 00 875

(51) Int. Cl.[7] ..... E05D 15/06

(52) U.S. Cl. ..... 160/197; 187/335; 49/116; 49/120

(58) Field of Search ..... 160/197, 113, 160/118, 133, 196.1; 187/335; 49/116, 120

(56) References Cited

U.S. PATENT DOCUMENTS

| | | | | |
|---|---|---|---|---|
| 3,260,303 | * | 7/1966 | Pipe | 160/197 |
| 3,999,489 | * | 12/1976 | Kramer et al. | 160/197 X |
| 4,224,877 | * | 9/1980 | Stark et al. | 105/250 |
| 4,841,689 | * | 6/1989 | Schussler | 160/197 X |
| 4,872,284 | | 10/1989 | Bentley . | |
| 4,982,528 | | 1/1991 | Michel . | |
| 5,290,077 | * | 3/1994 | Fleming | 292/35 |
| 5,386,886 | * | 2/1995 | Kobayashi et al. | 49/120 X |
| 5,524,941 | * | 6/1996 | Fleming | 292/34 |
| 5,690,189 | * | 11/1997 | Karner | 49/116 X |
| 5,899,302 | * | 5/1999 | O'Donnell | 187/314 |
| 5,988,320 | * | 11/1999 | Mittermayr | 187/319 |
| 6,067,826 | * | 5/2000 | Holloway et al. | 70/278.3 |

FOREIGN PATENT DOCUMENTS

| | | |
|---|---|---|
| 0685621 | 12/1995 | (EP) . |
| 2482175 | 11/1981 | (FR) . |

* cited by examiner

*Primary Examiner*—Daniel P. Stodola
*Assistant Examiner*—Bruce A. Lev
(74) *Attorney, Agent, or Firm*—Nils H. Ljungman & Associates

(57) ABSTRACT

Door system with a locking device which has top and bottom locking elements which can be displaced by a drive unit to realize a door system which is simple and easy to install, whereby the functional and operational reliability of the system are increased. For this purpose, associated with each of the top and bottom locking elements is an actuator element whereby the actuator elements are fastened to a single slide which is held on a beam so that it can move perpendicular to the sliding direction of the leaf and which can be moved indirectly by the drive unit.

20 Claims, 10 Drawing Sheets

LOCKING DEVICE FOR A DOOR SYSTEM

BACKGROUND OF THE INVENTION

1. Field of the Invention

The present invention is based on a door system to move and lock at least two door leaves, which door system may be equipped with a drive device to move the leaves between a position that opens a passage and a position that closes the passage, as well as with a locking device. The locking device can have a motor-side drive unit which is attached to a door frame profile, and top and bottom locking elements, whereby the top locking elements can be actuated by the drive unit in the position of the leaves that closes the passage, and to create a substantially interlocking or form-fitting connection in the vicinity of the top of the leaves between the leaves and a stationary part of the doors, whereby there can be lower locking elements that can be actuated by the drive unit and are located in the vicinity of the bottom of the leaves to create an additional interlocking connection between the leaves and the stationary part of the door system, and whereby the drive unit can be effectively connected with the locking elements only when the leaves are closed for locking and unlocking.

2. Background Information

A similar locking device is described in European Patent No. 0685621 A1. The locking device has top and bottom locking elements on leaves of an automatically actuatable door system which, when the leaves are in the closed position, lock the top and bottom portions of the door leaves. The top and bottom locking elements are mechanically coupled by means of a rod, so that both locking elements are actuated when the drive unit is started by means of a pivoted lever. The top locking elements lock the neighboring leaves with respect to one another, while the bottom locking elements fix the respective leaf directly to the floor. The top and bottom locking elements are automatically moved into an interlocking connection by a single drive unit. The interlocking connection of the locking elements thereby acts in all directions, i.e., both in the direction of movement and also perpendicular to it. The door system can be operated fully automatically by means of a switch. The door system can be locked and unlocked manually in the event of the failure of the power supply system.

The type of conversion of the motor movement to the locking elements and their complex mechanical coupling system must be seen as a disadvantage, because complex and time-consuming adjustment measures on the entire system are necessary during the installation and as a result of the inevitable tolerances that occur during the operation of the door system. On account of the direct mechanical coupling of the locking elements, it may not be possible to compensate for differences in the distances traveled between the top and bottom locking element, e.g. differences that may be caused by dirt in the floor guide, which can lead to the failure of both locking mechanisms. The pivoted lever device that couples the locking element during the movement of the leaves also requires a high degree of precision of the movement process. Even minor deviations mean that the driver pin, provided for the purpose, on the pivoted lever does not come into engagement with the corresponding indentation of a locking bracket, because the plane of the indentation is perpendicular to the direction of movement, and the indentation in the direction of movement of the leaf must be guided by means of the driver pin.

An additional disadvantage of at least one locking device described in some publications is that the locking device of the leaves can be tampered with mechanically—that is, a pin-shaped tool can be pushed between the leaves, so that when the appropriate pressure is exerted against the locking bracket, the top and bottom locking elements can be moved from their position and the leaves can be displaced.

OBJECT OF THE INVENTION

One object of the present invention is to create a locking device, involving a slide attached to a beam, which is simple and easy to install, whereby the reliability of operation and security against tampering is increased.

SUMMARY OF THE INVENTION

The present invention teaches that this object may be achieved by means of a slide, to which top and bottom actuator elements of the locking device are attached, which slide may be attached to a beam and may be configured and disposed to be moved on the beam transverse to a sliding direction of the movement of door leaves.

One possible embodiment of the present invention has the advantage that separate actuator elements can be associated with both the top and the bottom locking elements. Consequently, there may be essentially no direct interactions between the top and bottom locking elements. The mechanical coupling of the top and bottom locking elements may be accomplished by means of a slide which actuates both actuator elements by means of a single drive unit. A dual function of an actuator element may be greatly avoided, however. Differences in travel between the top and bottom locking elements caused by installation or operating conditions can consequently be greatly minimized or equalized by simple interventions in the separate subsystems. Larger differences can easily be minimized or equalized by post-installation adjustments on account of the greatly simple construction of the system, in which case the top and bottom locking elements can be adjusted separately. The top locking element acts on the truck and thus may create a lock which, in the event of an attempted break-in, creates a barrier that may not act directly on the leaf or leaves.

The actuator elements and the corresponding locking elements may be realized so that when the leaves are moved into the closed position, they are essentially easily and reliably engaged with each other even if there are minor movement tolerances, fluctuations, discrepancies, or inequalities. For this purpose, in particular, in another possible embodiment of the present invention, the plane of the recesses in the actuator element for the lower locking element may be oriented in the direction of sliding of the door leaves, for example, so that there is a greatly simple seat for the vertically movable rods. Moreover, because of the actuator element for the bottom locking element, security against tampering or attempted forced entry can be increased, because it may not be possible to push the neighboring leaves at a right angle to the direction of displacement of the leaves. The vertical locking may be accomplished by rods which are located in the frame of the leaf and are preferably invisible. With the recess, the actuator element can enclose seating means on the upper end of the rod and push the lower locking element on the bottom end of the rod, which may be in the form of a pin, into a floor bushing or socket. To prevent the penetration or insertion of foreign objects and thus a malfunction of the lock, the floor bushing or socket can be covered with an internal or retracted spring-loaded plate, which spring-loaded plate is opened only by the vertical pressure of the bottom locking element. After the rod has been unlocked, the floor bushing or socket is again closed by the plate. The other actuator element—that is, the top actuator element-may have, as the top locking element, bent fingers or hooks which are lowered vertically and are engaged in an engagement opening of a locking tongue located on the truck.

The overall greatly simple construction of the locking device essentially guarantees the functional reliability of the door system and reduces the time and cost involved in manufacturing and installation. The drive unit and a slide are located by means of a mounting bracket on a beam that is fastened in an essentially stationary manner to the door frame profile of the door leaf drive unit or door system. The slide may be coupled by means of a toothed rack and a gear wheel to the drive unit and is movably fastened to the beam. The two actuator elements can be fastened to the slide in the form of a forked plate and a locking hook which, when the leaves are closed, interact with the top and bottom locking elements.

The drive unit may be operated centrally by a switch. In the unlocked state and in the locked state, limit switches may be actuated, and by means of the limit switches, the drive unit may be then turned off. The limit switches may be fastened to the beam, whereby the contacting lugs of the limit switches may be actuated by the top and bottom ends of the toothed rack or rod. The short effective connection between the electrical drive unit and the mechanical system essentially guarantees a correct positioning of the locking elements. The limit switches may be fastened to vertical slots, so that during the installation of the door system, in particular, the initial correspondence between the limit switches and the positioning of the locking elements can be determined quickly, easily, and economically.

As a safety measure, e.g., in the event of a failure of the electric power supply or in the event of a malfunction, the locking device can be actuated manually. For this purpose, the shaft of the drive unit can be elongated and for this purpose can be connected at a suitable point on the door system, by means of a device that converts motion with or by means of a linearly movable and possibly spring-mounted handle. To compensate for manufacturing or installation tolerances, fluctuations, discrepancies, imperfections, or inequalities, it is reasonable to integrate at least one universal-joint propeller shaft over the entire length of the shaft.

The manual actuation system that is coupled with the drive shaft of the drive unit makes it essentially necessary to have the ability to electrically disconnect, isolate, or activate the drive unit or arrangement. To essentially simplify this process, there may be a device that makes possible a simplified and advantageous intervention in the drive unit. A switch located on the manual actuation system can be actuated chronologically prior to the actual mechanical manual unlocking and switches the drive unit into the disconnected or deactivated status, so that the locking device can be mechanically unlocked with little or greatly reduced effort or force.

The locking device taught by the present invention may be protected against external tampering. For example, in one possible embodiment of the present invention, it may be impossible to glide the leaves in the opening direction, or to push the leaves apart in a direction at right angles to the direction in which the leaves slide. The spaces between the leaves and the spaces in the upper area between the leaves and the door frame profile, which are potential targets for tampering, can be protected by appropriate devices. For example, in another possible embodiment of the present invention, a protective element which can be fastened to the beam underneath the forked plate or bottom actuator element or arrangement effectively or essentially prevents the forked plate from being pushed up through the space between the leaves. The space between the leaves and the door frame profile, through which a tool could likewise be inserted into the locking device, may be covered by cover means on the door frame profile.

In other words, in one possible embodiment of the invention, it may be essentially impossible to manually push or slide the door leaves in a direction in which the door leaves slide upon opening of the door leaves or upon closing of the door leaves, or to push the door leaves in a direction transverse to a direction in which the door leaves slide upon opening of the door leaves or upon closing of the door leaves.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and Applicants maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to one exemplary embodiment which is illustrated in the accompanying figures, in which.

DESCRIPTION OF THE PREFERRED EMBODIMENT

Figure 1:
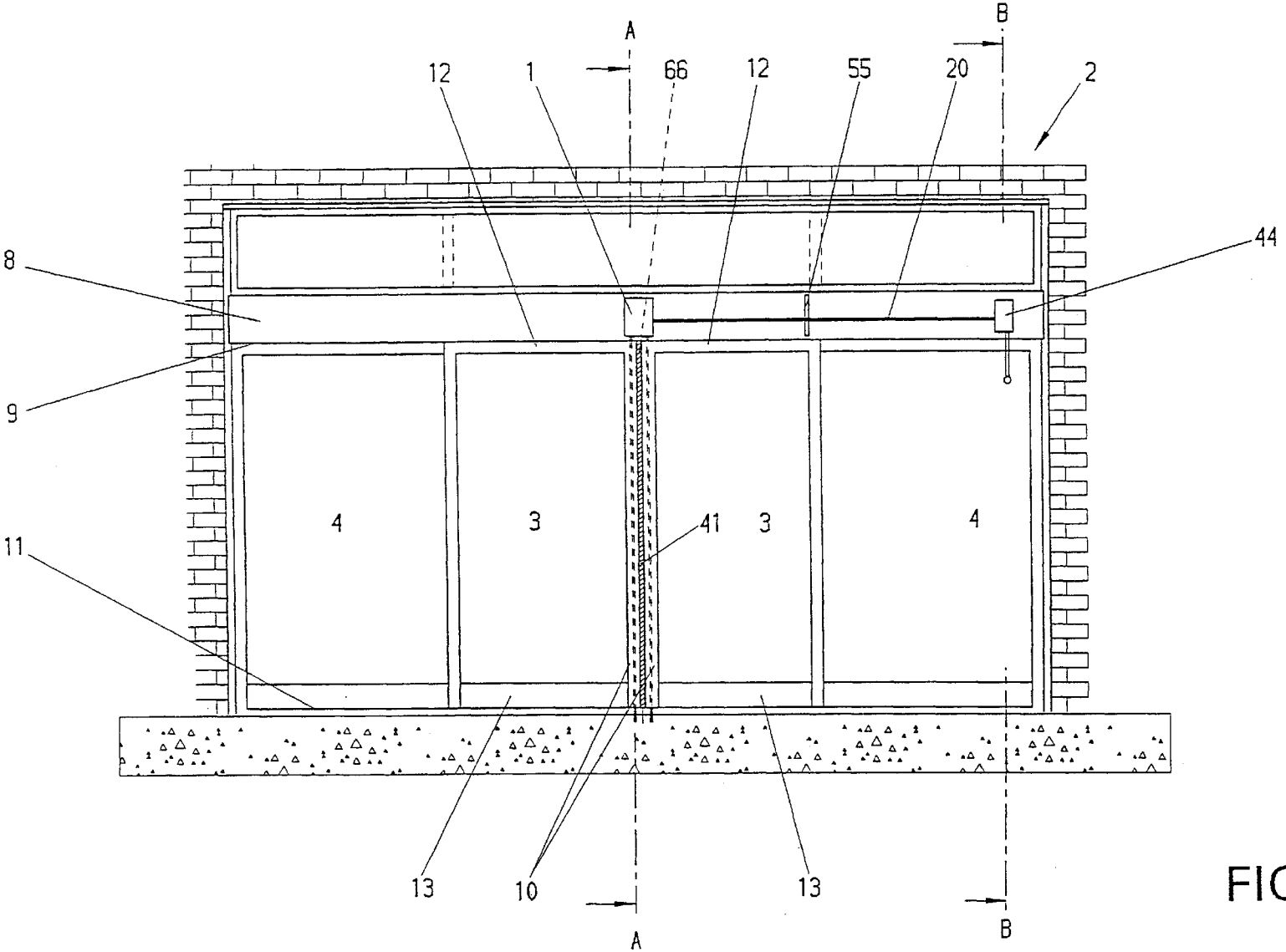
FIG. 1 is a schematic outer view of a multi-leaf door system with a locking device.

In the figures, identical or equivalent components are identified by the same reference numbers.

The function of the locking device 1 of the present invention is described below on the basis of a multi-leaf sliding door system 2 which is illustrated schematically in FIG. 1. However, the locking device 1 could also be used together with automatic door or gate systems that have single-leaf or multiple-leaf sliding doors or sliding gates or multiple-leaf folding-sliding doors or folding-sliding gates, and in systems in which there is at least one revolving door. In practical terms, the installation of the locking device 1 may be essentially equivalent in all of the door or gate systems described above.

The sliding door system 2 comprises two leaves 3 which are located so that they can slide between two stationary side parts 4, i.e., between a closed position and a position that opens a passage between them. Each leaf is suspended on two trucks 5, whereby the trucks 5 can be displaced along a runner rail 6 for the displacement of the leaves 3. The drive mechanism can be one or more motor-driven toothed belts 7, which are not described in any further detail, and are connected with the truck or trucks 5 in an appropriate manner. The drive units, the trucks and the runner rails 6 mentioned above are preferably installed in a door frame profile 8, which can extend over the entire length of the door system on the upper side 9 of the leaves 3.

Figure 2:
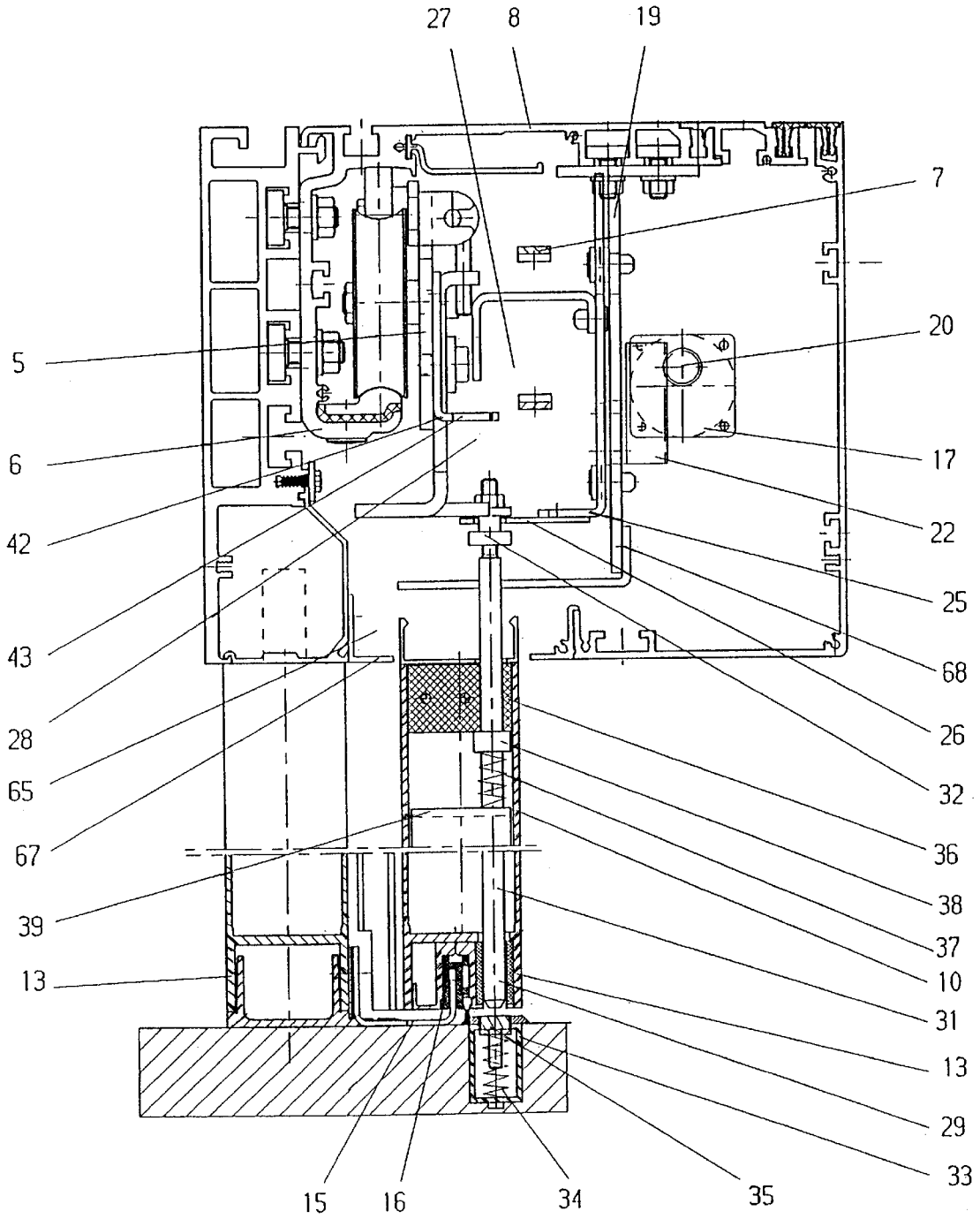
FIG. 2 is a longitudinal section of a door system along Line A—A in FIG. 1, shown in the unlocked position.
Figure 3:
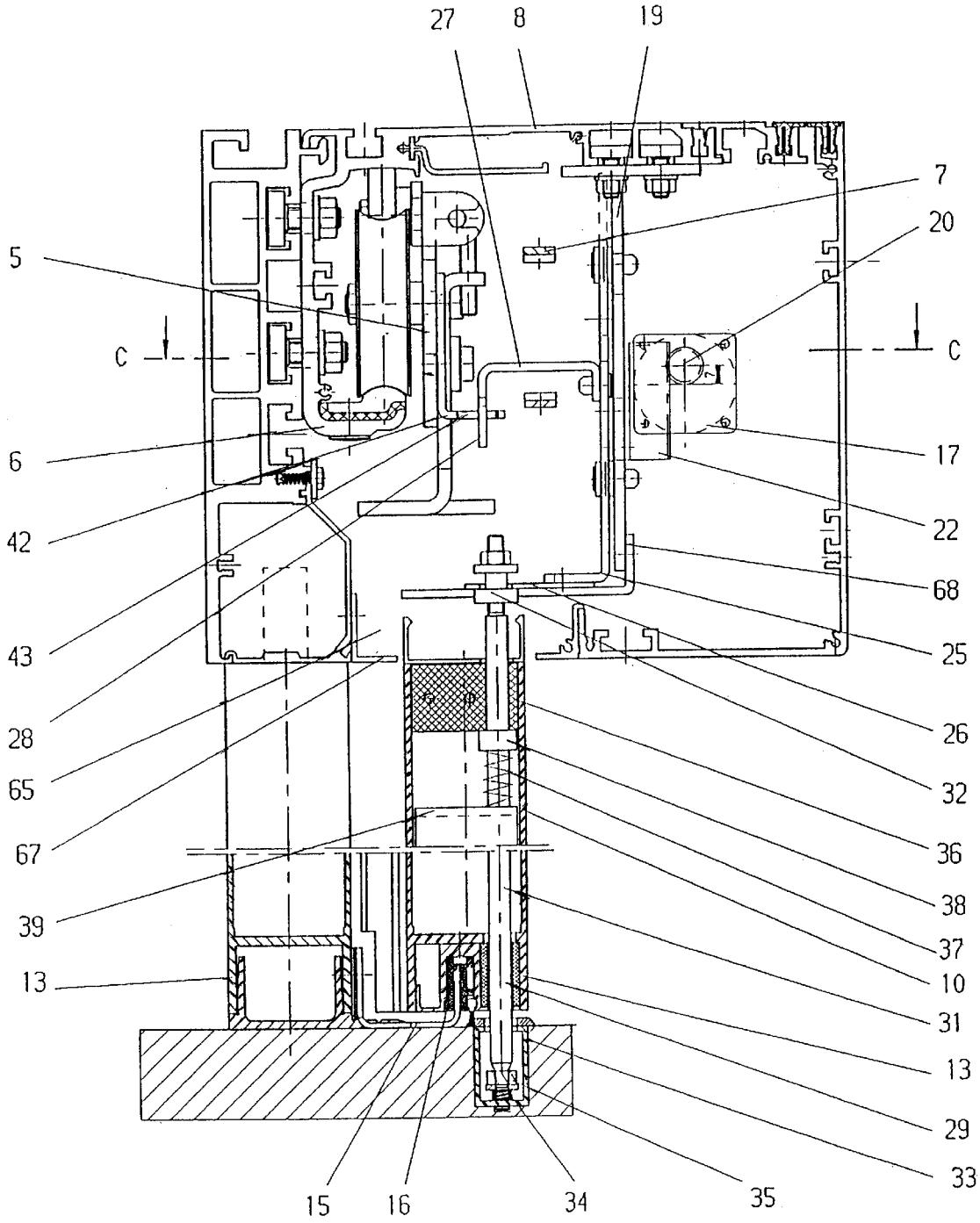
FIG. 3 is a longitudinal section of a door system as illustrated in FIG. 2, shown in the locked position.
Figure 11:
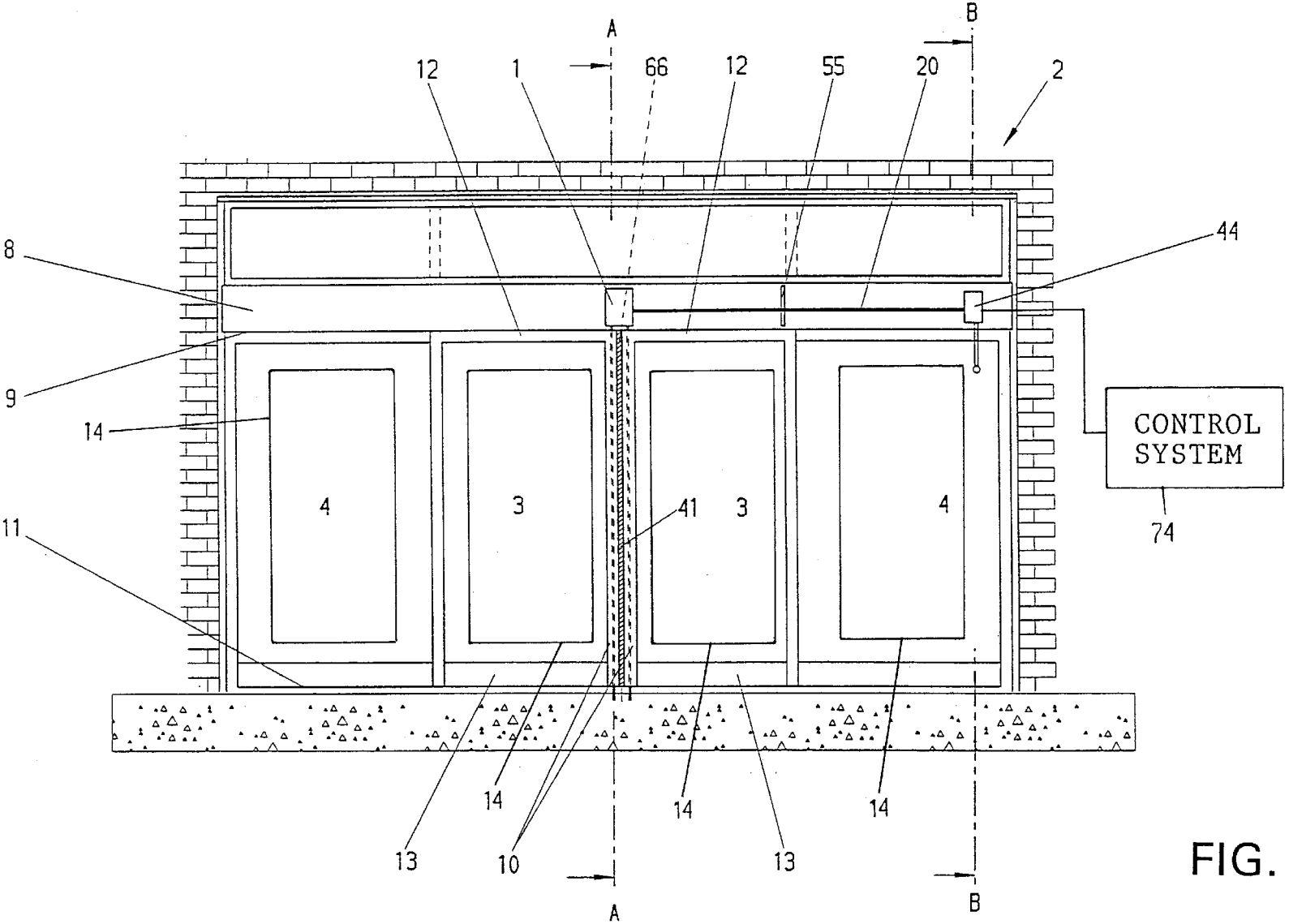
FIG. 11 is a duplicate of FIG. 1 with additional information, specifically, the connection of a control system to the door system, as well as an illustration of glass door panels.

The locking device 1 of the present invention is illustrated in detail in the other figures and is described in greater detail below. FIGS. 2 and 3 show longitudinal sections along Line A—A in FIG. 1, once in the unlocked position (FIG. 2) and once in the locked position (FIG. 3). FIG. 1 shows the leaves 3 and the side piece 4, which are closed with a vertical profile 10 that extends essentially axially over the entire height of the system. The upper side 9 and the bottom side 11 of the leaf 3 and of the side piece 4 each comprise a top profile 12 that runs horizontally as well as a lower profile 13 that runs horizontally, both of which are mechanically connected to the vertical profiles 10. Glass panels 14, as shown in FIG. 11, are embedded between the horizontal and vertical profiles 12, 13. Single-pane or multiple-pane glass panels can be used. The top horizontal profiles 12, to which the trucks 5 are fastened, project into the door frame profile 8. Visible on the bottom profile 13 of the side piece 4 is a floor guide bracket 15, which projects into a floor groove 16 of the bottom profile 13 of the leaf 3, to guide the leaf 3 during the sliding movement.

The locking device 1 comprises a drive unit 17 which is in the form of a geared motor, and which is fastened by means of a mounting bracket 18 to a beam 19 which is located in stationary fashion in the door frame profile 8. The geared motor 17 has a shaft 20 on which a gear wheel 21 is located which is effectively connected with a toothed rack 22. The toothed rack 22 is guided so that it can move vertically in an oblong opening 23 of the beam 10, and is connected by means of a spacer piece 24 with a slide 25, which is movably fastened on the side of the beam 19 opposite the mounting bracket 18. Located on the slide 25 are two actuator elements 26, 27. Fastened to the bottom of each actuator element is a forked plate 26 which projects downward at a right angle, and to the top is a locking hook 27 which is bent at two right angles.

Figure 4:
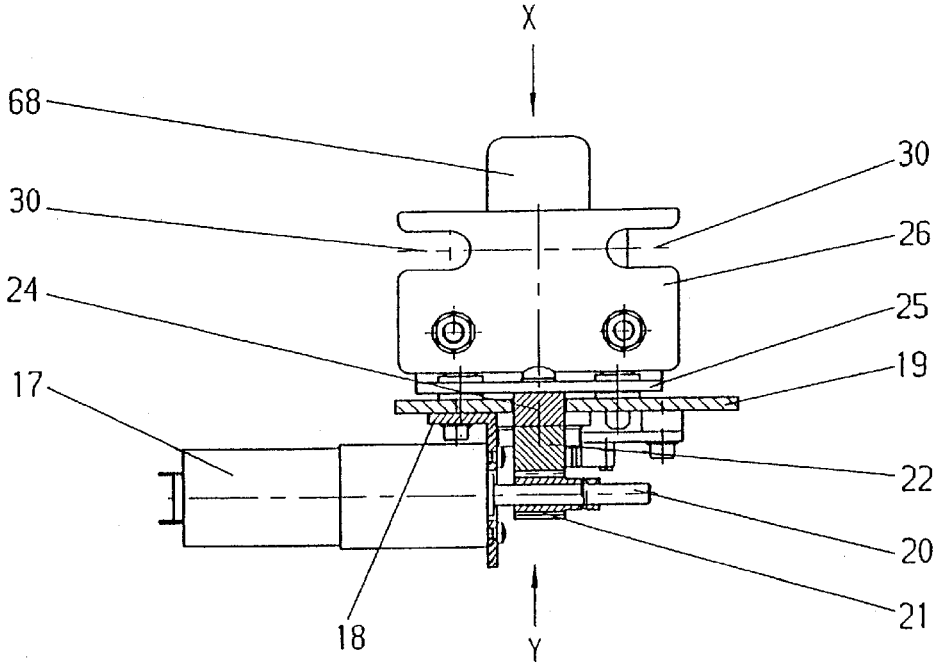
FIG. 4 is a cross section of a beam along line C—C in FIG. 3.
Figure 5:
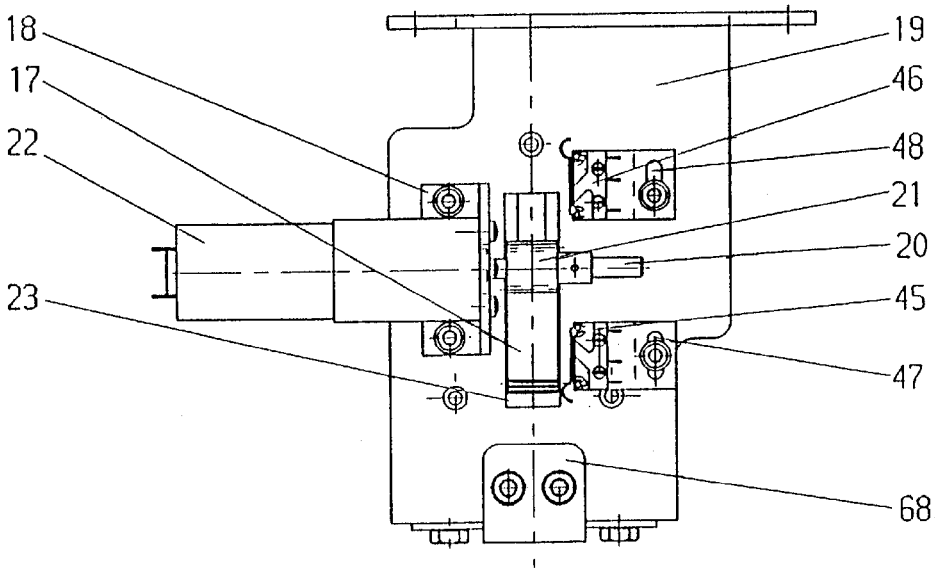
FIG. 5 is a view of a beam from direction X in FIG. 4.
Figure 6:
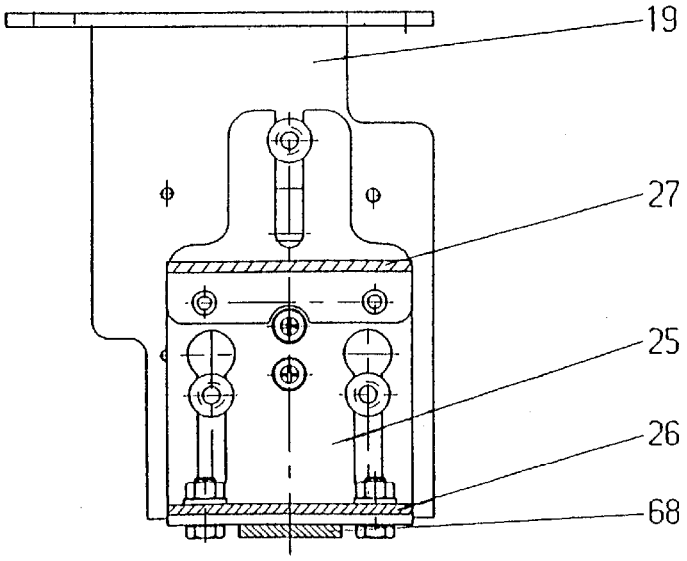
FIG. 6 is a view of a beam from direction Y in FIG. 4.

FIGS. 4 to 6 show detailed views of the top and bottom locking elements 28, 29 and of the drive unit 17. The forked plate 26 is bolted to the slide 25 and projects at a right angle. The forked plate 26 can be displaced in the vertical direction by the slide 25 and has two recesses 30 which are realized in mirror symmetry. The forked plate 26 interacts with vertically descending rods 31, whereby the recesses 30 come into engagement with seating means 32 which are located on the top of the rods 31. The bottom ends of the rods 31 are realized in the form of pins and represent the bottom locking elements 29 of the locking device 1. The rod 31 extends along the inside of the vertical profile 10 of the leaf 3 and is not visible from the outside. When the sliding door system 2 is in the unlocked position, the bottom locking elements 29 are raised inside the vertical profile 10, and in the locked position they are lowered so that they project into a floor bushing or socket 33. In this floor bushing 33 there is a spring 34 which closes the floor bushing 33 with an internal or retracting or retracted plate 35, and is pressed into the floor bushing 33 by the descent of the rod 31. Thus foreign objects cannot penetrate into the floor bushing 33 when the leaves 3 are in the unlocked position. When the lower locking elements 29 are in the lowered position, the leaves 3 are interlocked in the lower area. As a result of an appropriately heavy-duty realization of the bottom locking element 29, it is practically impossible to break through the leaves 3, even with the application of a great deal of force.

The rod 31 is guided in the vertical profile 10 in bearings 36 made of plastic or aluminum. A restoring spring 37 which is stretched between an adjustment collar 38 on the rod 31 and an adjustment bracket 39 located on the vertical profile 10, ensures that the bottom locking element 29 is held in the raised position. This is important primarily when the leaf 3 is not in the closed position, but is opened, or is just executing a sliding movement. The adjustment bracket 39 is accessible from above and can be displaced by means of a detachable threaded fastener, to adjust the correct restoration of the rod 31 during the initial installation or at any later time.

On each of the trucks 5 facing a main closing edge 41 there is a bent locking tongue 42, in which there is an engagement opening 43. The locking hook 27, which is bent in a U-shape, functions as an actuator element for the top locking element 28 and is riveted to the slide 25. On the front side, there are two fingers in the form of the top locking element 28, which are designed to engage in the locking tongues 42 of the trucks 5 of the leaf 3 to be locked. The locking hook 27 can be lowered by the slide 25. The fingers 28 are thereby engaged in the engagement openings 43 of the locking tongues 42 and block the respective truck in the direction of sliding of the leaf 3.

The shaft 20 of the geared motor 17 can be moved either by means of the electrical actuation of the geared motor 17 or by a manual actuation system 44 which is described below. For the vertical movement of the slide 25 from the unlocked position into the locked position or vice versa, the shaft 20 is rotated by a defined or predetermined angle in either direction of rotation. The gear wheel 21 that is fastened to it describes the curve of a circular orbit. To lock the door, as a result of the movement of the gear wheel 21, the toothed rack 22 and the slide 25 connected to it are lowered. The rotational movement of the shaft 20 and the vertical movement of the toothed rack 22 are coordinated with each other so that the toothed rack 22 can be moved back and forth between a lower position and an upper position. The lower position which corresponds to the locked position of the locking elements 28, 29 is thereby monitored by a limit switch 45 for the locked position, and the other position which corresponds to the unlocked position of the locking elements 28, 29 is monitored by an additional limit switch 46 for the unlocked position. The two limit switches 45, 46 are fastened to the beam 19 so that they can be adjusted by means of slots 47, 48, so that an essentially correct coordination can be achieved.

The function of the locking device 1 is described below. The two leaves are pushed toward each other either manually or by a motor until they come into contact with each other on the main closing edges 41, i.e. with the neighboring vertical profiles 10. The restoring springs 37 located in the vertical profiles 10 hold the rods 31 in their retracted position. When the leaves 3 are moved, the seating means 32 on both sides slide into the recesses 30 in the forked plate 26. Then the drive unit 17 is activated to lock the leaves 3. This action can be carried out by a switch that must be actuated manually or by a sensor (not shown). The drive unit 17 sets the shaft 20 and thus also the gear wheel 21 located on it into rotation. The rotational movement is converted by the toothed rack 22 into a linear movement that is directed vertically downward. The slide 25, which is in firm contact with the toothed rack 22 by means of the spacer piece 24, also slides downward in the oblong opening 23 of the beam 19 and lowers the locking hook 27 as well as the forked plate 26. The locking hook 27 is engaged with its fingers 28 in the respective locking tongue 42 of the truck 5. The forked plate 26 pushes on the seating means 32 of each rod 31 and causes a lowering of these rods 31, i.e. of the bottom locking element 29 into the corresponding floor bushing 33. The spring-mounted plate 35 is thereby pressed into the floor bushing 33. When the door is completely locked, the toothed rack 22 actuates the limit switch 45, so that the feed of electrical current to the drive unit 17 is interrupted and the drive stops. Unlocking is performed in the reverse sequence.

Figure 8:
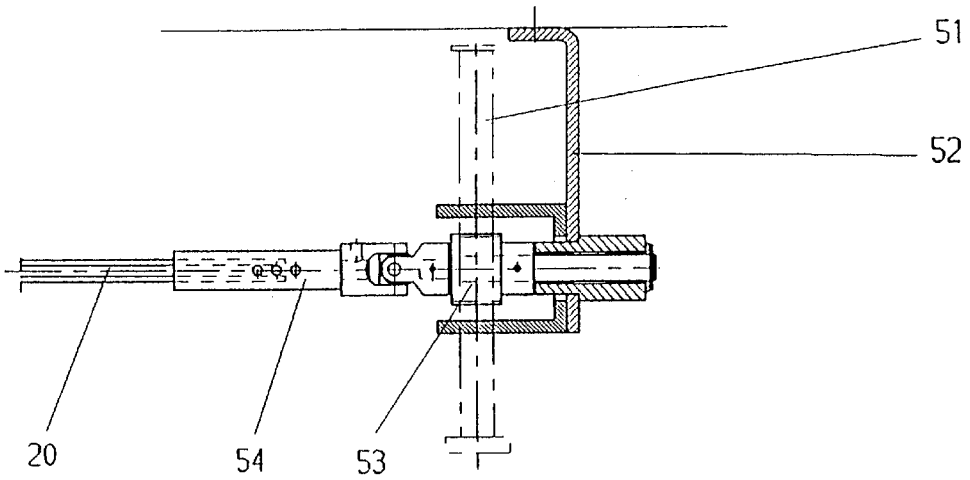
FIG. 8 is a vertical section through the manual actuation system along Line D—D in FIG. 7.
Figure 7:
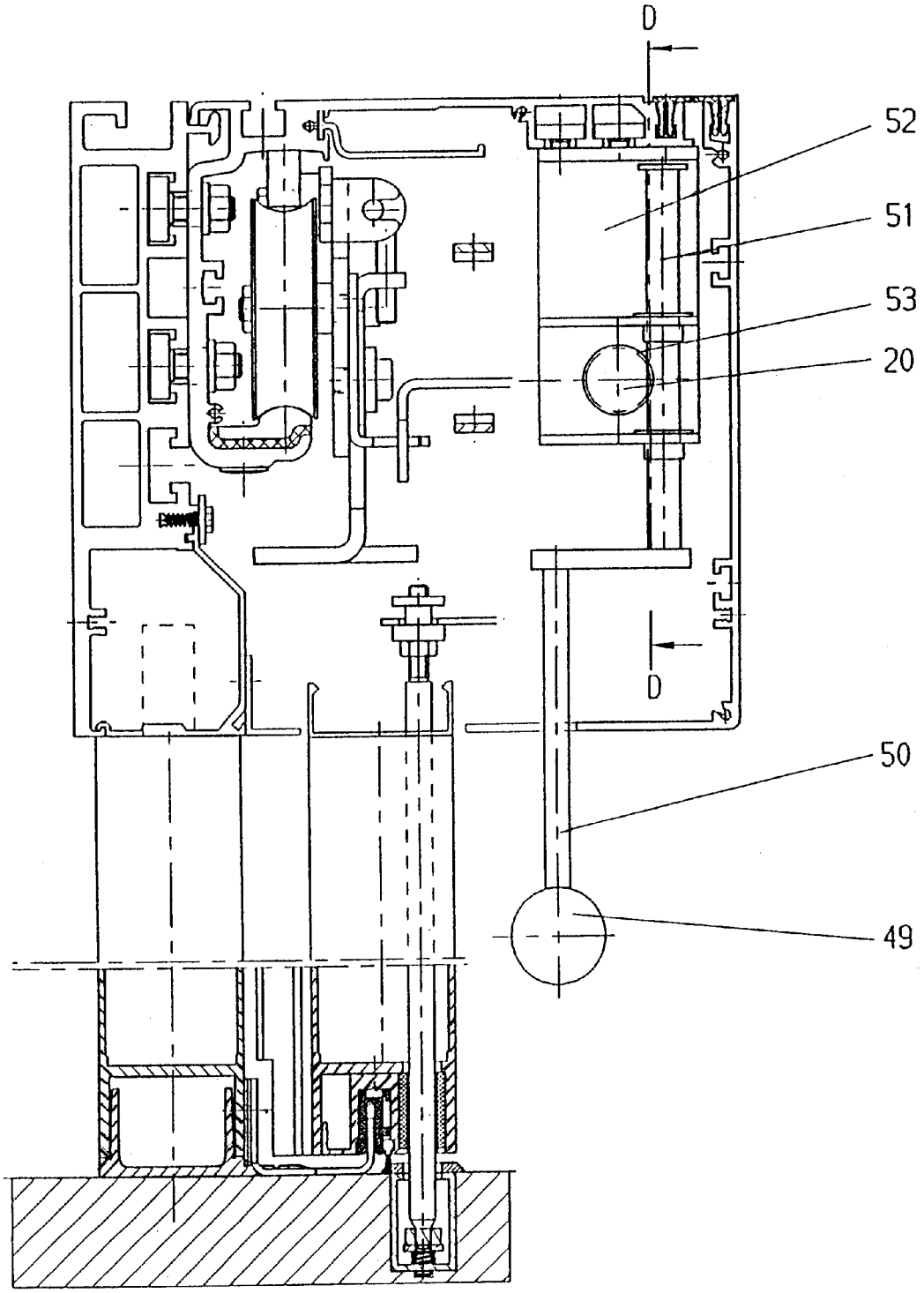
FIG. 7 is a longitudinal section through a manual actuation system of a door system along Line B—B in FIG. 1, shown in the locked position.

The shaft 20 of the drive unit 17 is also coupled with the manual actuation system 44 (FIGS. 7 and 8), so that in the event of a malfunction or power failure, the shaft 20 can be rotated manually and thus the slide 25 can be moved from the locked position into the unlocked position or vice versa. Preferably, the manual actuation system 44 is located on the inside of a door system. If the manual actuation system 44 is located on the outside, there must also be a safety measure so that only authorized persons can actuate the doors. The manual actuation system 44 has a handle 49 with a connecting rod 50 which, when it is activated in either vertical direction, can rotate the shaft 20 to the right or to the left. For this purpose the connecting rod 50 is connected with a round toothed rack 51 which is guided in a seating bracket 52 that is fastened to the door frame profile 8. The round toothed rack 51 works together with a gear wheel 53 which is located on the elongated shaft 20 of the drive unit 17 and thus acts on the locking elements 28, 29. The shaft connection between the drive unit 17 and the manual actuation system 44 is achieved by means of a universal-joint propeller shaft 54 to make it possible to compensate for tolerances by means of the length of the shaft 20. For guidance and stabilization, the shaft 20 runs in a guide bracket 55 in a plastic ring which is located on the door frame profile 8.

The manual actuation system 44 which is coupled with the shaft 20 of the drive unit 17 offers the capability of the electrical isolation of the drive unit 17. To simplify this process, the manual actuation system 44 is realized so that a simplified and advantageous intervention on the drive unit 17 is possible. By means of the manual actuation system 44, a switch 57 is actuated chronologically before the actual mechanical locking/unlocking, and switches the drive unit 17 into the isolated state, so that the locking device 1 can be mechanically locked or unlocked with only a small application of force.

Figure 9:
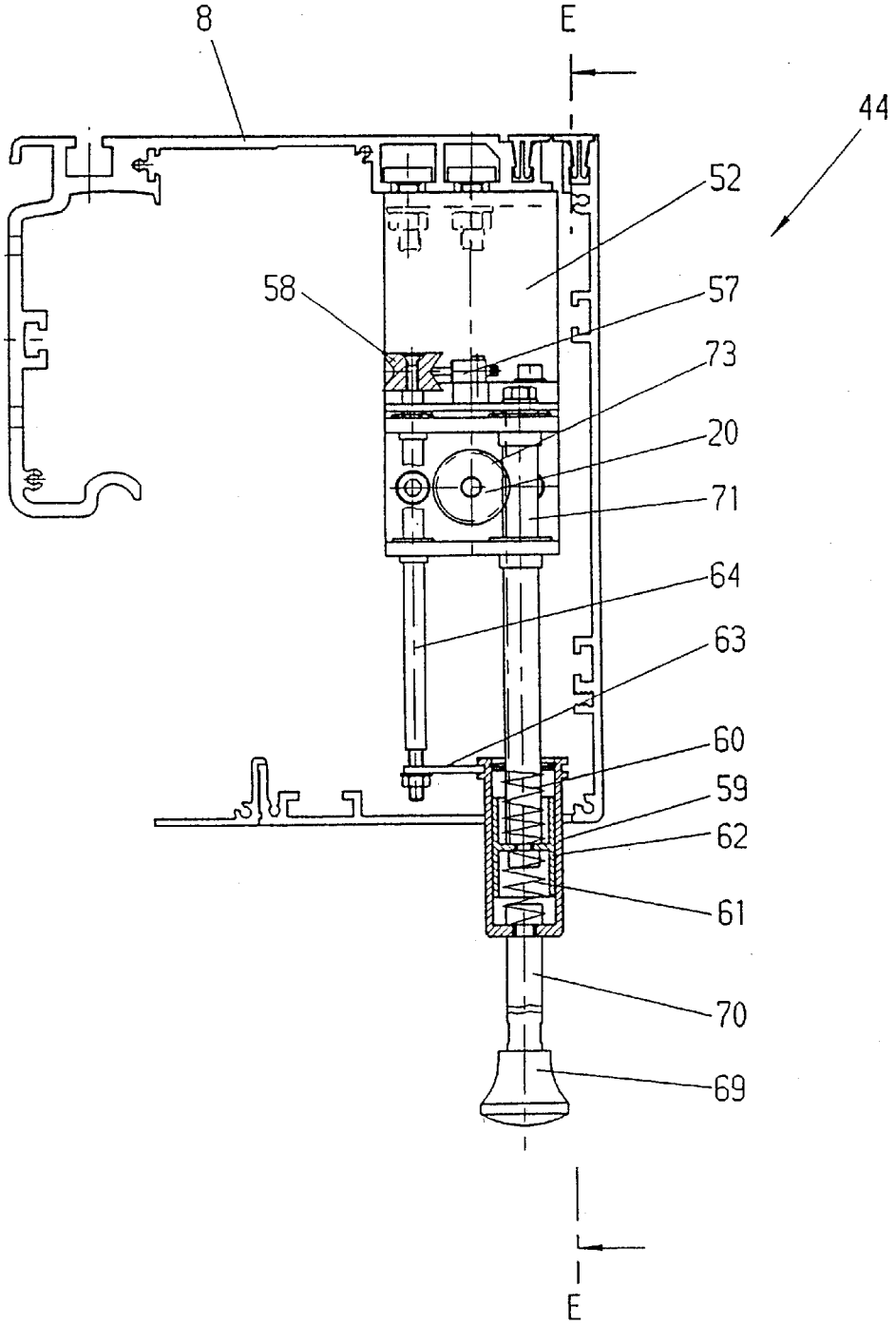
FIG. 9 is a longitudinal section of a door system with an additional exemplary embodiment of a manual actuation system.
Figure 10:
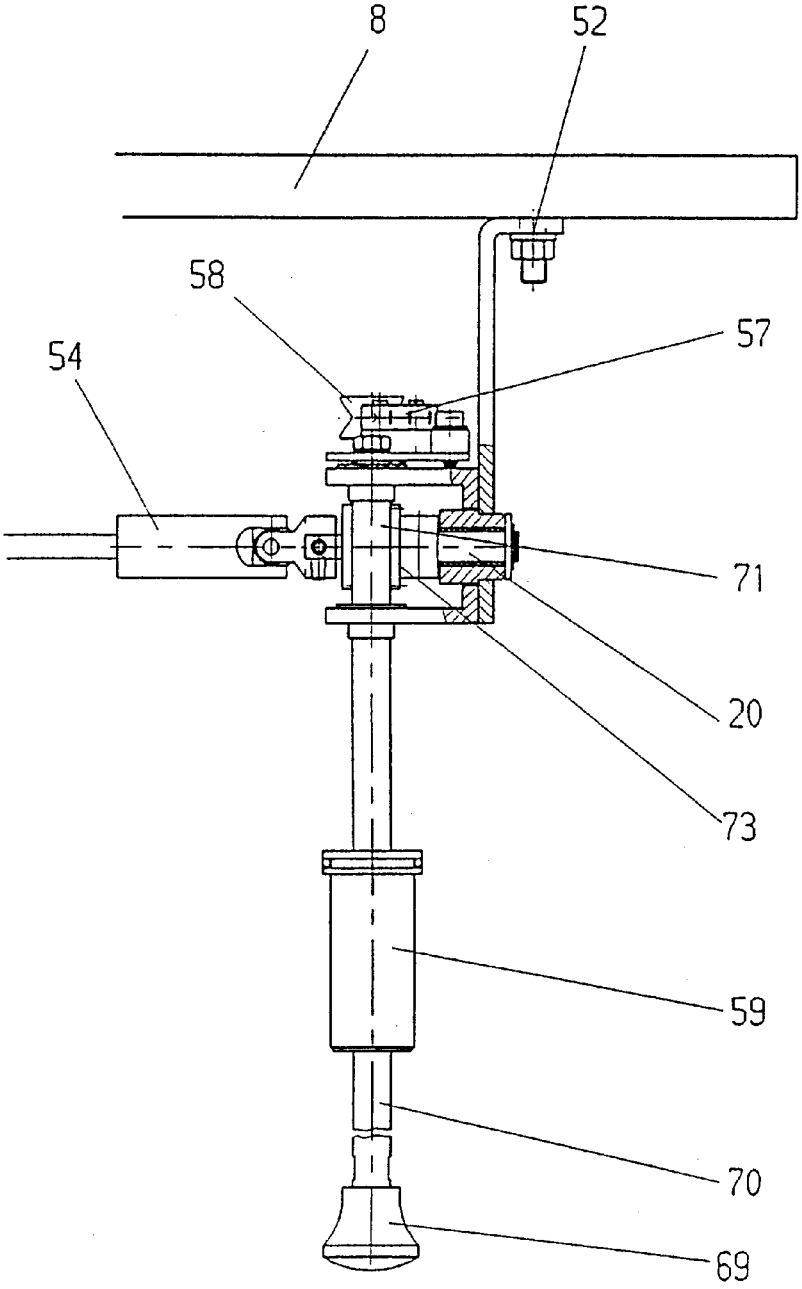
FIG. 10 is a vertical section through the manual actuation system along Line E—E in FIG. 9.
Figure 12:
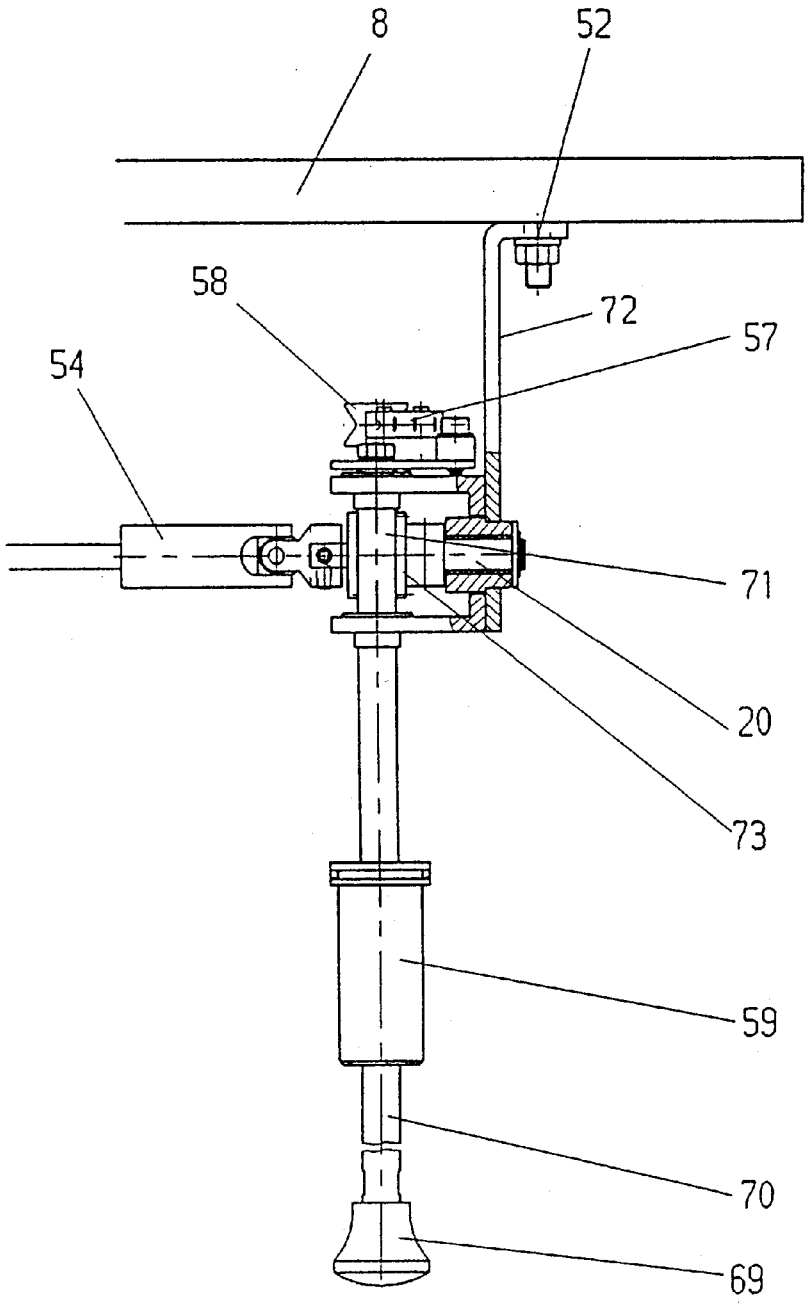
FIG. 12 is a duplicate of FIG. 10 with additional information.

Such a manual actuation system 44 is illustrated in FIGS. 9 and 10, which show a handle 69 connected by means of a connecting rod 70 with a helical spring mechanism 59, which is movably mounted in the door frame profile 8. In the helical spring mechanism 59 there is a guide sleeve 62 that is mounted between two compression springs 60, 61, and in which a round toothed rack or cylindrical toothed rack or round or cylindrical toothed rack arrangement 71 is fastened, which extends out of the top of the helical spring mechanism 59. The guide sleeve 62 can be moved over a defined distance up and down inside the helical spring mechanism 59. The round toothed rack 71 is guided in a seating bracket 72, as shown in FIG. 12, and acts as described above on the elongated shaft 20 and the locking elements 28, 29 by means of a gear wheel 73. On the outside of the helical spring mechanism 59 there is a driver 63 which has a shift or shifting linkage or shifting linkage arrangement 64. The shift linkage 64 is also guided in the seating bracket 72 and on the upper end has a cam 58 which is used to actuate the switch 57 that is fastened to the seating bracket 72. As a result of the guide sleeve 62 which is spring-mounted and movable between the shifting linkage 64 and ultimately the round or cylindrical toothed rack 71, there is an idle stroke when the manual actuation system 44 which is defined by the two compression springs 60, 61 is actuated, which idle stroke produces a lateral offset between the mechanical movement of the shifting linkage 64 and the round toothed rack 71, while the switch 57 puts the drive unit 17 into the necessary electrical state. Only when there is subsequent direct contact between the helical spring mechanism 59 and the guide sleeve 62 does the actual mechanical actuation of the locking elements 28, 29 occur with the correspondingly reduced application of force, because there is no need to work against the electrically maintained state of the drive unit.

In other words, the handle 59, 69 and the connecting rod arrangement 70 may be acted upon by a helical spring arrangement or mechanism 59, which helical spring mechanism 59 may be formed from a guide sleeve 62 to guide the connecting rod or connecting rod arrangement 70 and two compression springs 60, 61. The compression springs 60, 61 may act against and bias the guide sleeve 62.

The two leaves 3 may be interlocked in all directions by the locking device 1 described above. Additional security measures prevent direct tampering with the locking elements 28, 29. The spaces 65, 66 between the leaves 3 and between the door frame profile 8 and the leaves 3, which are potentially exposed to tampering, are covered by special measures. The space 65 at the door frame profile 8 is covered by cover means 67 which can be realized in one piece on the door frame profile 8 or can be fastened to it as a separate component. The insertion of a tool to activate the actuator element 27 is thereby effectively prevented. Tools inserted into the space 66 between the doors cannot be guided underneath the forked plate 26, because a protective element 68 which is fastened to the stationary beam 19 covers the critical area of the forked plate 26.

FIG. 11 is a duplicate of FIG. 1 with additional information. Specifically, FIG. 11 shows, according to at least one possible embodiment of the present invention, the connection of a control system 74 to the manual actuation system 44 and the locking device 1. A control system may be used to control a drive device for moving at least two door leaves between an open position and a closed position, the locking device 1, and the manual actuation system 44. Additionally, FIG. 11 shows glass panels 14, which, in at least one possible embodiment of the present invention, are embedded between the horizontal and vertical profiles 12, 13.

FIG. 12 is a duplicate of FIG. 10 with additional information. Specifically, FIG. 12 shows, according to at least one possible embodiment of the present invention, the mounting or seating bracket 72 for the shifting linkage arrangement 64, which seating bracket 72 guides the shifting linkage arrangement 64.

One feature of the invention resides broadly in the door system with at least two leaves 3, with a drive device to move the leaves 3 between a position that opens a passage and a position that closes the passage, as well as with a locking device 1, whereby the locking device 1 has a motor-side drive unit 17 that is attached to a door frame profile 8 and top and bottom locking elements 28, 29, whereby the top locking element 28 can be actuated by the drive unit 17 in the position of the leaves 3 that closes the passage, and to create an interlocking or form-fitting connection in the vicinity of the upper side 9 of the leaves 3 between the leaves and a stationary part of the door system 2, whereby there are bottom locking elements 29 that can be actuated by the drive unit 17 and are located in the vicinity of the underside 11 of the leaves 3 to create an additional interlocking connection between the leaves 3 and the stationary part of the door system 2, and whereby the drive unit 17 is effectively connected with the locking elements 28, 29 only when the leaves 3 are closed for locking and unlocking, characterized by the fact that actuator elements 26, 27 are associated with the top and the bottom locking elements 28, 29 respectively, whereby the actuator elements 26, 27 are fastened to a single slide 25 which is held so that it can be moved perpendicular to the sliding direction of the leaves 3 on a beam 19, and which can be moved indirectly by the drive unit 17.

Another feature of the invention resides broadly in the door system characterized by the fact that a rotating shaft 20 extends out of the drive unit 17 and has a gear wheel 21 which is engaged with a toothed rack 22 which is fixed to the slide 25.

Yet another feature of the invention resides broadly in the door system characterized by the fact that two limit switches 45, 46 which are adjustably fastened to the beam 19 can be activated by the toothed rack 22.

Still another feature of the invention resides broadly in the door system characterized by the fact that the actuator element 27 has recesses 30 opposite one another, into which the seating means 32 of rods 31 can be inserted, which rods are mounted so that they can move vertically in the leaves 3 and which have the lower locking elements 29.

A further feature of the invention resides broadly in the door system characterized by the fact that the leaves 3 can be locked in position by the actuator element 26 at a right angle to the sliding direction.

Another feature of the invention resides broadly in the door system characterized by the fact that the bottom locking elements 29 can be inserted into at least one floor bushing 33 which is covered by a spring-loaded plate 35.

Yet another feature of the invention resides broadly in the door system characterized by the fact that the actuator element 27 has bent fingers as the top locking element 28, which fingers can be inserted in locking tongues 42 of trucks 5.

Still another feature of the invention resides broadly in the door system characterized by the fact that a protective element 68 that surrounds the actuator element 26 is located on the beam 19.

A further feature of the invention resides broadly in the door system characterized by the fact that located on the door frame profile 8 are cover means 67 which cover a slit 65 between the leaf 3 and the door frame profile 8.

Another feature of the invention resides broadly in the door system characterized by the fact that a manual locking/unlocking of the leaf 3 is performed by means of a manual actuation system 44 that is coupled with the shaft 20 of the drive unit 17, whereby a handle 49, 69 is movable mounted on the door frame profile 8 and has a round toothed rack 51, 71 that interacts with a gear wheel 53, 73 which is also fastened to the shaft 20.

Yet another feature of the invention resides broadly in the door system characterized by the fact that the manual actuation system 44 has an electrical actuation system to isolate, deactivate, or disconnect the drive unit 17, which can be activated by the manual actuation system 44 before the manual locking/unlocking of the leaf 3.

Still another feature of the invention resides broadly in the door system characterized by the fact that the handle 49, 69 is connected in one piece and without any play with a shifting linkage 64 and is spring-mounted, realizing an idle stroke with the round toothed rack 71.

A further feature of the invention resides broadly in the door system characterized by the fact that realized in one piece on a helical spring mechanism 59 are a handle 69 and a shifting linkage 64, and a guide sleeve 62 is mounted in the helical spring mechanism 59 so that it can move between two compression springs 60, 61, whereby the guide sleeve 62 has the round toothed rack 61 that extends out of the helical spring mechanism 59.

One feature of the invention resides broadly in a door system configured to move and lock at least two door leaves, said door system comprising: a control system configured to drive said door system; a drive device configured and disposed to move at least two door leaves between an open position and a closed position; a locking device; and said locking device comprising: a motor-side drive unit configured to be attached to a door frame arrangement; a top locking element configured and disposed to be actuated by said drive unit in a closed position of connected door leaves; said top locking element being configured to form a connection generally at the upper side of at least two door leaves and between door leaves and a door frame arrangement; a bottom locking element configured and disposed to be actuated by said drive unit; said bottom locking element being configured to be disposed generally at the underside of door leaves; said bottom locking element being configured to be disposed to form an additional connection between door leaves and a door frame arrangement; said drive unit being configured to be disposed to effectively connect with said top locking element and said bottom locking element only upon door leaves, connected to said drive unit, being in a closed position for locking and unlocking connected door leaves; a top actuator element, said top actuator element being configured to be connected to said top locking element; a bottom actuator element, said bottom actuator element being configured to be connected to said bottom locking element upon connected leaves being in a closed position; said top actuator element and said bottom actuator element being attached to a single slide; said slide being configured and disposed to be driven indirectly by said drive unit; a beam; and said slide being configured and disposed to be moved on said beam and said slide also being configured and disposed to move transverse to a sliding direction of movement of door leaves.

Another feature of the invention resides broadly in a door system configured to move and lock at least two door leaves, said door system comprising: a control system configured to drive said door system; a drive device configured and disposed to move at least two door leaves between an open position and a closed position; a locking arrangement; and said locking arrangement comprising: a drive arrangement configured to be attached to a door frame arrangement; a top locking arrangement configured and disposed to be actuated by said drive arrangement in a closed position of connected door leaves; said top locking arrangement being configured to form a connection generally at the upper side of at least two door leaves and between door leaves and a door frame arrangement; a bottom locking arrangement configured and disposed to be actuated by said drive arrangement, said bottom locking arrangement being configured to be disposed generally at the underside of door leaves; said bottom locking arrangement being configured to be disposed to form an additional connection between door leaves and a door frame arrangement; said drive arrangement being configured to be disposed to effectively connect with said top locking arrangement and said bottom locking arrangement only upon door leaves, connected to said drive arrangement, being in a closed position for locking and unlocking connected door leaves; a top actuator arrangement, said top actuator arrangement being configured to be connected to said top locking arrangement; a bottom actuator arrangement, said bottom actuator arrangement being configured to be connected to said bottom locking arrangement upon connected door leaves being in a closed position; said top actuator arrangement and said bottom actuator arrangement being attached to a single slide arrangement; said slide arrangement being configured and disposed to be driven by said drive arrangement; a beam arrangement; and said slide arrangement being configured and disposed to be moved on said beam arrangement.

Yet another feature of the invention resides broadly in a door system 2 with a locking device 1 which has top and bottom locking elements 28, 29 which can be displaced by a drive unit 17 to realize a door system 2 which is essentially simple and easy to install, whereby the functional and operational reliability of the system are greatly increased. For this purpose, associated with each of the top and bottom locking elements 28, 29 is an actuator element 26, 27,, whereby the actuator elements 26, 27 are fastened to a single slide 25 which is held on a beam 19 so that it can move perpendicular to the sliding direction of the leaf 3 and which can be moved indirectly by the drive unit 17.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A door system configured to move and lock at least two door leaves, said door system comprising:

a control system configured to drive said door system;

a drive device configured and disposed to move at least two door leaves between an open position and a closed position;

a locking device; and said locking device comprising:

a motor-side drive unit configured to be attached to a door frame arrangement;

a top locking element configured and disposed to be actuated by said drive unit in a closed position of connected door leaves;

said top locking element being configured to form a connection generally at the upper side of at least two door leaves and between door leaves and a door frame arrangement;

a bottom locking element configured and disposed to be actuated by said drive unit, said bottom locking element being configured to be disposed generally at the underside of door leaves;

said bottom locking element being configured to be disposed to form an additional connection between door leaves and a door frame arrangement;

said drive unit being configured to be disposed to effectively connect with said top locking element and said bottom locking element only upon door leaves, connected to said drive unit, being in a closed position for locking and unlocking connected door leaves;

a top actuator element, said top actuator element being configured to be connected to said top locking element;

a bottom actuator element, said bottom actuator element being configured to be connected to said bottom locking element upon connected door leaves being in a closed position;

said top actuator element and said bottom actuator element being attached to a single slide;

said slide being configured and disposed to be driven indirectly by said drive unit;

a beam; and said slide being configured and disposed to be moved on said beam and said slide also being configured and disposed to move transverse to a sliding direction of movement of door leaves.

2. The door system according to claim 1, wherein:

said drive unit comprises a rotating shaft;

said rotating shaft extends out of said drive unit;

said locking device further comprises a gear wheel, said gear wheel being configured and disposed to be connected to said rotating shaft;

said gear wheel is engaged with a toothed rack; and said toothed rack is attached to said slide.

3. The door system according to claim 2, wherein said door system further comprises:

two limit switches; and said two limit switches are adjustably attached to said beam and said two limit switches also are configured to be driven by said toothed rack.

4. The door system according to claim 3, wherein:

said bottom actuator element comprises a top side and a bottom side;

said bottom actuator element comprises a top recess and a bottom recess;

said top recess is disposed at said top side;

said bottom recess is disposed at said bottom side;

said door system further comprises rods;

said rods are configured to be disposed to move vertically to lock and unlock door leaves;

said rods comprise seating means; and said seating means of said rods are configured to be inserted into and held by said top recess and said bottom recess.

5. The door system according to claim 4, wherein:

said bottom actuator element is configured to be disposed to lock door leaves; and said bottom actuator element is configured to be disposed to move at an angle transverse to a sliding direction of movement of door leaves.

6. The door system according to claim 5, wherein said door system further comprises:

at least one floor socket arrangement configured to be disposed in a floor;

a spring-loaded plate configured and disposed to substantially prevent insertion of foreign objects into said at least one floor socket arrangement;

said spring-loaded plate is configured and disposed to cover said at least one floor socket arrangement and said spring-loaded plate is configured to open upon said bottom locking element pressing vertically on said spring-loaded plate; and said bottom locking element is configured to be inserted into said at least one floor socket arrangement upon opening of said spring-loaded plate.

7. The door system according to claim 6, wherein said door system further comprises:

a truck, said truck being configured to be disposed to support a door leaf;

a locking tongue disposed in said truck; and said top locking element is configured to be inserted into said locking tongue.

8. The door system according to claim 7, wherein:

said locking device further comprises a protective element, said protective element being configured and disposed to substantially prevent insertion of foreign objects into spaces between door leaves; and said protective element is attached to said beam and is configured and disposed to cover said bottom actuator element.

9. The door system according to claim 8, wherein said door system further comprises cover means, said cover means being configured to substantially prevent insertion of foreign objects into a slit between a door leaf and a door frame arrangement.

10. The door system according to claim 9, wherein said door system further comprises:

a manual actuation arrangement for manually locking and unlocking door leaves; and said manual actuation arrangement comprises:

a handle, said handle being configured to attach movably to a door frame arrangement;

a gear wheel arrangement, said gear wheel arrangement being attached to said rotating shaft;

a cylindrical toothed rack, said cylindrical toothed rack being disposed to drive said gear wheel arrangement; and said handle is configured to actuate said cylindrical toothed rack.

11. The door system according to claim 10, wherein said manual actuation arrangement further comprises a drive unit deactivation arrangement for deactivating said drive unit to permit manual locking or unlocking of door leaves.

12. The door system according to claim 11, wherein said manual actuation arrangement further comprises:

a spring arrangement, said spring arrangement being configured to bias said handle;

said handle is connected with a shifting linkage arrangement; and said shifting linkage arrangement provides a play between said handle and said shifting linkage arrangement.

13. The door system according to claim 12, wherein said manual actuation arrangement further comprises:

a connecting rod arrangement;

said spring arrangement comprises a helical spring arrangement;

said handle and said connecting rod arrangement are disposed to be acted upon by said helical spring arrangement;

said connecting rod arrangement and said handle form one unitary part;

said helical spring arrangement comprises:

a guide sleeve to guide said connecting rod arrangement; and two compression springs;

said cylindrical toothed rack is connected to said connecting rod arrangement to be moved by said handle;

said cylindrical toothed rack is disposed away from said helical spring arrangement; and said two compression springs are configured and disposed to act against and bias said guide sleeve.

14. A door system configured to move and lock at least two door leaves, said door system comprising:

a control system configured to drive said door system;

a drive device configured and disposed to move at least two door leaves between an open position and a closed position;

a locking arrangement; and said locking arrangement comprising:

a drive arrangement configured to be attached to a door frame arrangement;

a top locking arrangement configured and disposed to be actuated by said drive arrangement in a closed position of connected door leaves;

said top locking arrangement being configured to form a connection generally at the upper side of at least two door leaves and between door leaves and a door frame arrangement;

a bottom locking arrangement configured and disposed to be actuated by said drive arrangement, said bottom locking arrangement being configured to be disposed generally at the underside of door leaves;

said bottom locking arrangement being configured to be disposed to form an additional connection between door leaves and a door frame arrangement;

said drive arrangement being configured to be disposed to effectively connect with said top locking arrangement and said bottom locking arrangement only upon door leaves, connected to said drive arrangement, being in a closed position for locking and unlocking connected door leaves;

a top actuator arrangement, said top actuator arrangement being configured to be connected to said top locking arrangement;

a bottom actuator arrangement, said bottom actuator arrangement being configured to be connected to said bottom locking arrangement upon connected door leaves being in a closed position;

said top actuator arrangement and said bottom actuator arrangement being attached to a single slide arrangement;

said slide arrangement being configured and disposed to be driven by said drive arrangement;

a beam arrangement; and said slide arrangement being configured and disposed to be moved on said beam arrangement.

15. The door system according to claim 14, wherein said slide arrangement is configured and disposed to move transverse to a sliding direction of movement of door leaves.

16. The door system according to claim 14, wherein:

said drive arrangement comprises a rotating shaft;

said rotating shaft extends out of said drive arrangement;

said locking arrangement further comprises a gear wheel, said gear wheel being configured to be connected to said rotating shaft;

said gear wheel is engaged with a toothed rack; and said toothed rack is attached to said slide arrangement.

17. The door system according to claim 16, wherein said door system further comprises:

two limit switches; and said two limit switches are adjustably attached to said beam arrangement and said two limit switches also are configured to be driven by said toothed rack.

18. The door system according to claim 17, wherein:

said bottom actuator arrangement comprises a top side and a bottom side;

said bottom actuator arrangement comprises a top recess and a bottom recess;

said top recess is disposed at said top side;

said bottom recess is disposed at said bottom side;

said door system further comprises rods;

said rods are configured to be disposed to move vertically to lock and unlock door leaves;

said rods comprise seating means; and said seating means of said rods are configured to be inserted into and held by said top recess and said bottom recess.

19. The door system according to claim 18, wherein:

said bottom actuator arrangement is configured to be disposed to lock door leaves;

said bottom actuator arrangement is configured to be disposed to move at an angle transverse to a sliding direction of movement of door leaves;

said door system further comprises:

at least one floor socket arrangement configured to be disposed in a floor;

a spring-loaded plate configured and disposed to substantially prevent insertion of foreign objects into said at least one floor socket arrangement;

said spring-loaded plate is configured and disposed to cover said at least one floor socket arrangement and said spring-loaded plate is configured to open upon said bottom locking arrangement pressing vertically on said spring-loaded plate;

said bottom locking arrangement is configured to be inserted into said at least one floor socket arrangement upon opening of said spring-loaded plate;

a truck arrangement, said truck arrangement being configured to be disposed to support a door leaf;

a locking tongue disposed in said truck arrangement; and cover means, said cover means being configured to substantially prevent insertion of foreign objects into a slit between a door leaf and a door frame arrangement;

said bottom locking arrangement is configured to be inserted into said at least one floor socket arrangement upon opening of said spring-loaded plate;

said top locking arrangement is configured to be inserted into said locking tongue;

said locking arrangement further comprises a protective arrangement, said protective arrangement being configured and disposed to substantially prevent insertion of foreign objects into spaces between door leaves; and said protective arrangement is attached to said beam arrangement and is configured and disposed to cover said bottom actuator arrangement.

20. A door system according to claim 19, wherein said door system further comprises:

a manual actuation arrangement for manually locking and unlocking door leaves;

said manual actuation arrangement comprises:

a handle, said handle being configured to attach movably to a door frame arrangement;

a gear wheel arrangement, said gear wheel arrangement being attached to said rotating shaft;

a cylindrical toothed rack, said cylindrical toothed rack being disposed to drive said gear wheel arrangement;

said handle is configured to actuate said cylindrical toothed rack;

a drive arrangement deactivation arrangement for deactivating said drive arrangement to permit manual locking or unlocking of door leaves;

a spring arrangement, said spring arrangement being configured to bias said handle;

said handle is connected with a shifting linkage arrangement;

said shifting linkage arrangement provides a play between said handle and said shifting linkage arrangement;

a connecting rod arrangement;

said spring arrangement comprises a helical spring arrangement;

said handle and said connecting rod arrangement are disposed to be acted upon by said helical spring arrangement;

said connecting rod arrangement and said handle form one unitary part;

said helical spring arrangement comprises:

a guide sleeve to guide said connecting rod arrangement; and two compression springs;

said cylindrical toothed rack is connected to said connecting rod arrangement to be moved by said handle;

said cylindrical toothed rack is disposed away from said helical spring arrangement; and said two compression springs are configured and disposed to act against and bias said guide sleeve.

* * * * *